US007273635B2

(12) United States Patent
Purvis et al.

(10) Patent No.: US 7,273,635 B2
(45) Date of Patent: Sep. 25, 2007

(54) METHOD OF FORMING ALUMINIDE DIFFUSION COATINGS

(75) Inventors: Andrew L. Purvis, New Era, MI (US); Bruce M. Warnes, Beaver, PA (US); Irving R. McFarren, Muskegon, MI (US); Joel L. Cockerill, Montague, MI (US)

(73) Assignee: Howmet Corporation, Whitehall, MI (US)

( * ) Notice: Subject to any disclaimer, the term of this patent is extended or adjusted under 35 U.S.C. 154(b) by 150 days.

(21) Appl. No.: 10/674,059

(22) Filed: Sep. 29, 2003

(65) Prior Publication Data

US 2005/0069642 A1 Mar. 31, 2005

(51) Int. Cl.
*C23C 16/12* (2006.01)

(52) U.S. Cl. ..... 427/250; 427/253

(58) Field of Classification Search ..... 427/250, 427/252, 253

See application file for complete search history.

(56) References Cited

U.S. PATENT DOCUMENTS

| | | | | |
|---|---|---|---|---|
| 4,761,267 | A | 8/1988 | Takeno et al. | |
| 4,977,036 | A | 12/1990 | Baldi | |
| 5,028,385 | A | 7/1991 | Baldi | |
| 5,124,006 | A | 6/1992 | Fayeulle et al. | |
| 5,261,963 | A | 11/1993 | Basta et al. | |
| 5,264,245 | A | 11/1993 | Punola et al. | |
| 5,407,704 | A | 4/1995 | Basta et al. | |
| 5,462,013 | A | 10/1995 | Punola et al. | |
| 5,658,614 | A * | 8/1997 | Basta et al. | 427/253 |
| 5,716,720 | A | 2/1998 | Murphy | |
| 5,788,823 | A | 8/1998 | Warnes et al. | |
| 5,789,089 | A | 8/1998 | Maki et al. | |
| 5,856,027 | A | 1/1999 | Murphy | |
| 5,989,733 | A | 11/1999 | Warnes et al. | |
| 6,074,602 | A | 6/2000 | Wukusick et al. | |
| 6,129,991 | A | 10/2000 | Warnes et al. | |
| 6,136,451 | A | 10/2000 | Warnes et al. | |
| 6,143,361 | A * | 11/2000 | Near et al. | 427/248.1 |
| 6,153,313 | A | 11/2000 | Rigney et al. | |
| 6,168,874 | B1 | 1/2001 | Gupta et al. | |
| 6,258,461 | B1 | 7/2001 | Baldi et al. | |
| 6,273,678 | B1 | 8/2001 | Darolia | |
| 6,291,014 | B1 * | 9/2001 | Warnes et al. | 427/252 |
| 6,344,282 | B1 | 2/2002 | Darolia et al. | |
| 6,472,018 | B1 * | 10/2002 | Warnes et al. | 427/250 |
| 6,602,356 | B1 * | 8/2003 | Nagaraj et al. | 148/283 |
| 6,689,422 | B1 * | 2/2004 | Warnes et al. | 427/255.11 |

FOREIGN PATENT DOCUMENTS

| | | |
|---|---|---|
| EP | 0 496 935 | 8/1992 |
| EP | 0 933 448 | 8/1999 |
| EP | 1 079 073 | 2/2001 |
| EP | 1209247 | 5/2002 |
| JP | 08260147 | 10/1995 |

OTHER PUBLICATIONS

Conner et al.; "Evaluation of Simple Aluminide and Platinum Modified Aluminide Coatings on High Pressure Turbine Blades after Factory Engigne Testing", Proc. AMSE Int. Conf. of Gas Turbine and Aero Engine Congress Jun. 3-6, 1991, and Jun. 1-4, 1992. No page numbers.

"Surface-Aluminizing of Pt With $AlCl_3$ Vapor," Nanko et al., Electrochemical Society Proceedings, vol. 99, No. 38, 2000, pp. 236-246.

* cited by examiner

*Primary Examiner*—Bret Chen

(57) ABSTRACT

Method of forming an outwardly grown aluminide diffusion coating on a superalloy substrate disposed in a coating retort including the steps of heating the substrate to a temperature of 900 to 1200 degrees C., flowing a coating gas comprising aluminum trichloride and a carrier gas through the coating retort at a flow rate of the coating gas of about 100 to about 450 standard cubic feet per hour, providing a concentration of aluminum trichloride in the retort of less than 1.4% by volume of the coating gas, and providing a total pressure of the coating gas in the coating retort of about 100 to about 450 Torr.

6 Claims, 8 Drawing Sheets

METHOD OF FORMING ALUMINIDE DIFFUSION COATINGS

FIELD OF THE INVENTION

The present invention relates to a method of forming an aluminide diffusion coating on a substrate.

BACKGROUND OF THE INVENTION

At temperatures greater than about 1000° C. (1832° F.), high temperature oxidation is the most important form of environmental attack observed with aluminide diffusion coatings. High temperature oxidation is a chemical reaction whose rate controlling process for an aluminide coating is diffusion through a product (oxide) layer. Diffusion is a thermally activated process, and consequently, the diffusion coefficients are exponential functions of temperature. Since the oxidation of aluminide coatings is a diffusion controlled reaction and diffusion coefficients are exponential functions of temperature, the oxidation rate is also an exponential function of temperature. At low temperatures where diffusion coefficients are relatively small, the growth rate of a protective scale on any aluminide coating is also small. Thus, adequate oxidation resistance should be provided by any state of the art aluminide coatings, such as: chromium aluminide, aluminide or two phase [$PtAl_2$+(Ni,Pt)Al] platinum aluminide, all inward grown coatings made by pack cementation. However, at high temperatures where the diffusion coefficients and consequently the oxidation rate increase rapidly with increasing temperature, only coatings which form high purity alumina ($Al_2O_3$) scales are likely to provide adequate resistance to environmental degradation.

The presence of platinum in nickel aluminide has been concluded to provide a number of thermodynamic and kinetic effects which promote the formation of a slow growing, high purity protective alumina scale. Consequently, the high temperature oxidation resistance of platinum modified aluminide diffusion coatings generally is better as compared to simple aluminide diffusion coatings not containing platinum.

Many of the problems encountered with the previous industry standard platinum aluminides having a two phase, inwardly grown structure have been overcome by using outwardly grown, single phase platinum aluminide coatings as described, for example, in the Conner et al. technical articles entitled "Evaluation of Simple Aluminide and Platinum Modified Aluminide Coatings on High Pressure Turbine Blades after Factory Engine testing", Proc. AMSE Int. Conf. of Gas Turbines and Aero Engine Congress Jun. 3-6, 1991 and Jun. 1-4, 1992. For example, the outwardly grown, single phase aluminide diffusion coating microstructure on directionally solidified (DS) Hf-bearing nickel base superalloy substrates was relatively unchanged after factory engine service in contrast to the microstructure of the previous industry standard two phase aluminide coating. Further, the growth of a CVD single phase platinum aluminide coating was relatively insignificant compared to two phase aluminide coatings during factory engine service. Moreover, the "high temperature low activity" outward grown platinum aluminide coatings were observed to be more ductile than inward grown "low temperature high activity" platinum aluminide coatings.

U.S. Pat. Nos. 5,658,614; 5,716,720; 5,856,027; 5,788,823; 5,989,733; 6,129,991; 6,136,451; and 6,291,014 describe a CVD process for forming a single phase, outwardly grown platinum aluminide diffusion coating modified with platinum or other elements on a nickel base superalloy substrate. U.S. Pat. Nos. 5,261,963; 5,264,245; 5,407,704; and 5,462,013 describe typical chemical vapor deposition (CVD) apparatus for forming a diffusion aluminide coating on a substrate.

SUMMARY OF THE INVENTION

The present invention provides a CVD method of forming an outwardly grown diffusion aluminide coating on a substrate wherein the outwardly grown diffusion aluminide coating includes a diffusion zone adjacent to the substrate and an additive layer disposed on the diffusion zone and wherein the aluminizing parameters are controlled to substantially reduce the time needed to form the coating on the substrate while affecting coating properties in a beneficial manner. In accordance with an illustrative embodiment of the present invention, at least one of the concentration of aluminum trichloride ($AlCl_3$) in the coating gas in the coating chamber and the total pressure of coating gas in the coating chamber is/are reduced to provide an unexpected increase in growth rate of an outwardly grown aluminide diffusion coating on the substrate, while affecting coating properties, such as average aluminum concentration in the additive layer and oxidation resistance, in a beneficial manner.

In a particular illustrative embodiment of the invention, one or more superalloy substrates to be coated are disposed in a retort coating chamber and heated to an elevated substrate coating temperature in the range of about 900 to about 1200 degrees C. A coating gas comprising $AlCl_3$ and a carrier gas, such as hydrogen, is flowed at a flow rate of about 100 to about 450 scfh (standard cubic feet per hour) through the coating chamber. A total pressure of coating gas in the coating chamber is maintained from about 100 to about 450 Torr. The concentration of $AlCl_3$ in the coating gas in the coating chamber is less than about 1.4% by volume. The substrate can be provided with a layer comprising platinum or other element to be incorporated into the outwardly grown aluminide diffusion coating to modify its properties, such as high temperature oxidation resistance.

Preferred coating parameters comprise a flow rate of coating gas through the coating chamber of about 200 to 400 scfh, a total pressure of coating gas in the coating chamber of about 100 to 300 Torr, and a concentration of $AlCl_3$ in the coating chamber of about 0.6% to about 1.2% by volume of the coating gas in the coating chamber. Even more preferred coating parameters may comprise a coating gas flow rate of about 300 scfh, a total pressure of coating gas in the coating chamber of about 200 Torr, and a concentration of $AlCl_3$ in the coating chamber of about 1.0% by volume of the coating gas.

The above-described coating parameters are advantageous to decrease the time needed to form an outwardly grown aluminide diffusion coating on a superalloy substrate by about 40% or more, depending upon the particular substrate being coated.

Other advantages of the present invention will become apparent from the following description taken with the following drawings.

DESCRIPTION OF THE DRAWINGS

In FIGS. 4-5 and 7-8, the diffusion zone corresponds to the distance where Al is approximately 15 weight %.

FIG. 5 is a graph of aluminum concentration profiles (in weight %) across aluminide coatings formed on Rene' N5 superalloy starting from the coating outer surface S, which corresponds to 0 distance on the horizontal axis. Shown are electron probe microanalysis (EPMA) profiles from samples obtained from rapid cycle variants of CVD aluminizing runs with platinum, for various concentrations of $AlCl_3$. The remaining run parameters were a retort pressure of 450 Torr and a total gas flow of 300 scfh.

FIG. 7 is a graph of aluminum profile concentration (in weight %) measured by EPMA across aluminide coatings formed on Rene' N5; namely, coated with a CVD simple aluminide using the rapid CVD process of an embodiment of the invention, starting from the coating outer surface S, which corresponds to 0 distance on the horizontal axis. Shown are the profiles of process variants, using a constant temperature (1080° C.), $AlCl_3$ concentration (1.0%) and gas flow rate (300 scfh), while varying the retort pressure.

FIG. 8 is a graph of the aluminum profile concentration (in weight %) measured by EPMA across aluminide coatings formed on alloy Rene' N5; namely, coated with a CVD platinum aluminide using the rapid CVD process of an embodiment of the invention, starting from the coating outer surface S, which corresponds to 0 distance on the horizontal axis. Shown are the profiles of process variants, using a constant temperature (1080° C.), $AlCl_3$ concentration (1.0%), and gas flow rate (300 scfh), while varying the retort pressure.

DESCRIPTION OF THE INVENTION

Figure 11:
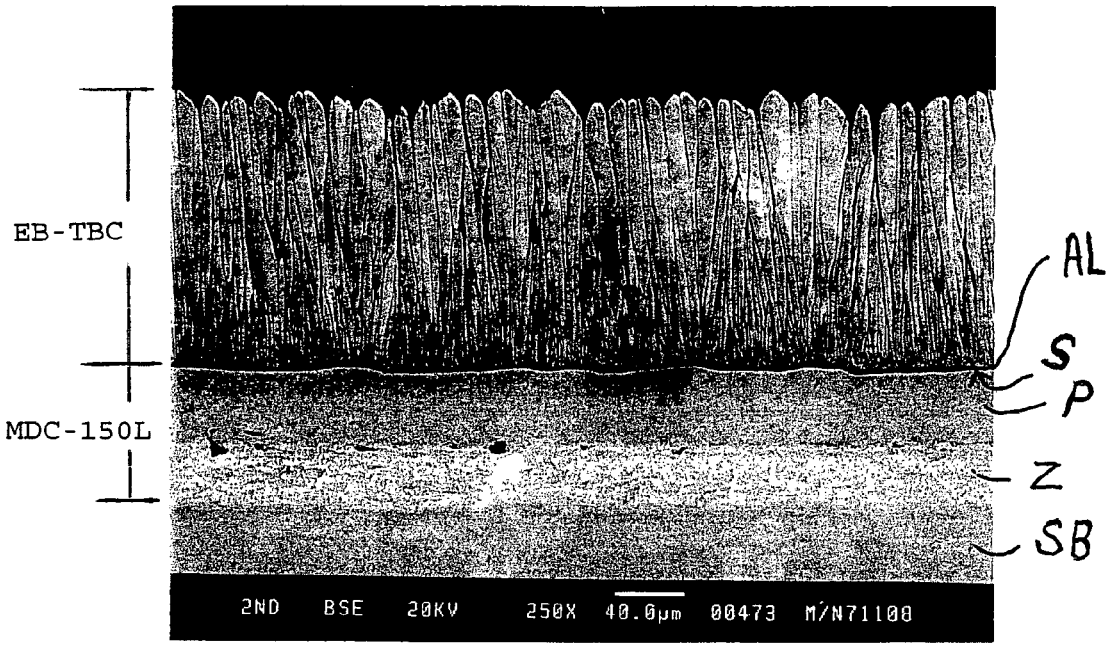
FIG. 11 is photomicrograph of a representative outwardly grown aluminide diffusion coating designated MDC-150L on a nickel base superalloy substrate SB wherein the coating has a diffusion zone Z adjacent the substrate and an additive layer P disposed on the diffusion zone. The outer surface of the additive layer P is the outermost surface of the aluminide diffusion coating. A thermal barrier coating EB-TBC is shown residing on an alumina layer formed on the additive layer P.

For purposes of illustration and not limitations, the invention will be described herebelow with respect to forming outwardly grown simple (unmodified) aluminide diffusion coatings and platinum modified aluminide diffusion coatings on particular nickel base superalloy substrates. As shown in FIG. 11, a representative outwardly grown aluminide diffusion coating, whether simple or platinum modified, includes a diffusion zone Z adjacent the substrate SB and an additive layer P disposed on the diffusion zone Z. The additive layer P can comprise a single NiAl phase or single (Pt,Ni)Al phase where the Pt is in solid solution. A second phase may be present in the NiAl phase or the (Pt,Ni)Al phase depending on element(s) that may be added to coating. The outer surface S of the additive layer P is the outermost surface of the aluminide diffusion coating relative to the substrate. A thermal barrier coating EB-TBC is shown disposed on an alumina layer AL formed on the additive layer P, the thermal barrier coating on the alumina layer being possible optional further coating structure that form no part of the invention and are not part of the aluminide diffusion coating made pursuant to the invention.

The invention can be practiced to form simple (unmodified) outwardly grown aluminide diffusion coatings and modified outwardly grown aluminide diffusion coating where the coating is modified to include an element in addition to Ni and Al, on various superalloy substrates, such as nickel base superalloy substrates, cobalt based superalloy substrates, and superalloy substrates that include two or more of nickel, cobalt and iron. Such superalloys are known to those skilled in the art. Some of these superalloys are described in the book entitled "Superalloys II", Sims et al., published by John Wiley & Sons, 1987.

The examples described below involve nickel base superalloy substrates comprising a known Rene' N5 superalloy for purposes of illustration and not limitation. The Rene' N5 nickel base superalloy is described in U.S. Pat. No. 6,074,602. The specimens tested in the examples below had a nominal composition, in weight %, of 7% Cr, 8% Co, 2% Mo, 5% W, 7% Ta, 3% Re, 6.2% Al, 0.2% Hf, and balance essentially Ni.

CVD low activity aluminizing test runs were made in a coating reactor or retort of the type shown in U.S. Pat. No. 5,261,963 which is incorporated herein by reference. The coating reactor or retort had a coating chamber with a nominal diameter of 20 inches and nominal height of 40 inches. A coating gas comprising $AlCl_3$ and balance hydrogen is generated in one or more gas generators disposed outside of the retort as described in U.S. Pat. No. 5,407,704 by flowing a mixture of hydrogen chloride gas and hydrogen carrier gas over a bed of aluminum particles. The coating gas then is flowed through the retort coating chamber as described in U.S. Pat. No. 5,658,614. The experiments described below were conducted in such a CVD reactor or retort using six substrate-receiving trays spaced four inches apart along the central vertical axis in the coating chamber of the retort.

Rene' N5 nickel base superalloy tab samples [dimensions: 25.4 mm×12.7 mm×3 mm] with round edges and corners (suitable for oxidation testing) were used as test material in the aluminizing runs. Four tab samples of the alloy (with and without platinum electroplated layer thereon) were aluminized under various conditions of interest, then one tab was used for chemical analysis and the other three were used for cyclic oxidation testing. The platinum electroplated layer was plated to have a weight of 6 milligrams/$cm^2$ and electroplated in accordance with U.S. Pat. No. 5,788,823.

One test sample from each group was cross-sectioned, mounted, polished and examined on both a light and an electron microscope. The coating thickness was measured (average of ten readings) with the light microscope, and composition profiles for major elements in the additive layer of the coatings were obtained with an electron microprobe. The aluminum concentration in the additive layer was calculated by averaging the points in the profile.

CVD low activity aluminizing test runs were made with various aluminum halide concentrations and total pressures in the above coating retort. After CVD coating, representative samples of the above superalloy (each with and without Pt) were prepared for metallographic examination. The remaining samples of each type were cyclic oxidation tested at 1177° C. (2150° F.).

For example, a first series of CVD low activity aluminizing runs were made at 1080° C. (1975° F.) substrate temperature and a total pressure in the retort coating chamber of 200 Torr (0.26 atm.) for the above nickel base superalloy. Four different aluminum trichloride ($AlCl_3$) concentrations in hydrogen carrier gas were considered, specifically: a) 1%, b) 0.5%, c) 0.1%, and d) 0.05% by volume of the coating gas ($AlCl_3$ plus hydrogen carrier gas). The $AlCl_3$ concentration set forth is that present in the coating gas in the retort coating chamber. The total gas flow through the system during the experiments was 300 standard cubic feet per hour (scfh). The aluminum halide generator was operated at 290° C. (554° F.) with 20 scfh hydrogen ($H_2$) and the appropriate hydrogen chloride (HCl) flow to yield the desired $AlCl_3$ concentration in the coating gas in the coating chamber.

A second series of aluminizing runs were made at constant: a) substrate temperature (1080° C.), b) $AlCl_3$ concentration (1.0% by volume of coating gas in retort) and c) gas flow rate (300 scfh). In this test series, four different total pressures in the coating chamber were considered, 200 Torr (0.26 atm.), 320 Torr (0.42 atm.), 450 Torr (0.59 atm.) and 650 Torr (0.86 atm.).

A third series of aluminizing runs were made at constant: a) substrate temperature (1080° C.), b) $AlCl_3$ concentration (1.0% by volume of coating gas) and c) pressure (200 Torr). In this test series, different gas flow rates were considered, 150 scfh, 300 scfh and 450 scfh.

One sample from each group tested was cross-sectioned, mounted, polished, and examined on both a light and an electron microscope. The coating thickness was measured (average of ten readings) with the light microscope, and composition profiles for major elements in the coating were obtained using electron probe microanalysis. The aluminum concentration in the additive layer was calculated by averaging the points in the profile.

Cyclic oxidation testing of the remaining samples in each group was performed at 2150° F. (1177° C.). The dimensions of the tab test samples were measured to the nearest 0.1 mm and the surface area was then calculated. Next, the test samples were cleaned in acetone, and the mass was measured to the nearest 0.1 mg. Finally, the samples were tested in a laboratory tube furnace apparatus. One furnace cycle consisted of fifty minutes at temperature followed by ten minutes air cooling. The mass of the samples was measured before and after each fifty-cycle test interval, and, after each test interval, the changes in mass from all samples of a given type were averaged. Finally, the average mass change for each type of sample was plotted against the number of cycles. In these tests, failure was defined as a mass loss of 2 mg/$cm^2$ relative to the initial sample mass.

Coating Growth Kinetics

The CVD aluminizing process is a gas-solid reaction that produces a solid product layer between the reactants. Hence, once the product layer is continuous, it is a diffusion controlled reaction that exhibits parabolic kinetics. The parabolic rate law, see equation 1, indicates that the thickness (X) of the coating is directly related to the square root of the reaction time (t).

$$X=(k_{p(eff)}t)^{1/2} \quad (1)$$

In the equation one, $k_{p(eff)}$ is the apparent growth rate constant for the alloy and deposition conditions considered, and it is related to the reactant diffusion coefficients in the product layer. Following each aluminizing experiment, the average thickness was measured for each coating type, and then the rate constant was calculated for each experiment using the measured thickness values and the experimental aluminizing time.

Figure 1:
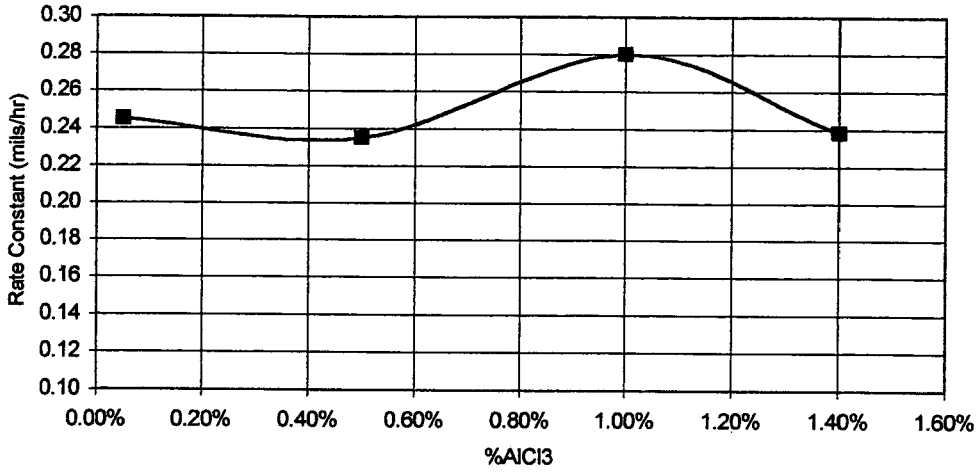
FIG. 1 is a graph of diffusion growth rate constants obtained from 10 hour CVD aluminizing cycles with various concentrations of $AlCl_3$ for Rene' N5 superalloy. Process variables held constant were the temperature (1080° C.), pressure (450 Torr) and total gas flow rate (300 scfh).

FIG. 1 summarizes the data from the first series of test runs. In particular, FIG. 1 provides a plot of the apparent growth rate constant as a function of $AlCl_3$ concentration in the retort coating chamber at 450 Torr total pressure and 300 scfh gas flow for coatings on the Rene' N5 samples (no Pt electroplated layer). There appears to be an apparent maximum inflection point in the rate of coating growth at a concentration of 1.0% by volume $AlCl_3$ in the coating gas in the coating chamber for the superalloy. If the $AlCl_3$ concentration is set at or near this approximate inflection point with other coating parameters constant, a significant reduction in coating process time can be achieved. For example, the coating test runs in the examples involved a coating processing time of only 10 hours as compared to a typical coating processing time of 12 to 20 hours, such as 16 hours, employed at higher concentrations of $AlCl_3$ in the coating retort.

Figure 2:
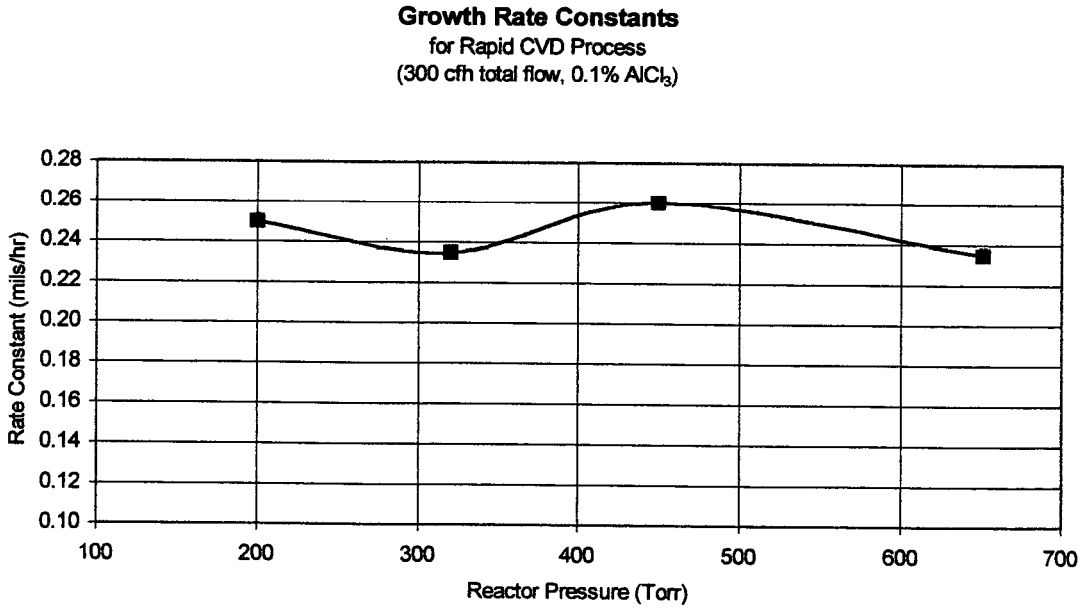
FIG. 2 is a graph of diffusion growth rate constants obtained from 10 hour CVD aluminizing cycles with various retort pressures for Rene' N5 superalloy. Process variables held constant were the temperature (1080° C.), $AlCl_3$ concentration (0.1%) and total gas flow rate (300 scfh).

FIG. 2 summarizes the data from the second series of test runs. In particular, FIG. 2 provides a plot of the coating growth rate constant as a function of total retort pressure at constant $AlCl_3$ concentration (0.1 by volume of coating gas) in the reactor and total flow (300 scfh). FIG. 2 also shows an apparent maximum inflection point in the graphs at a reactor pressure of 450 Torr and an additional inflexion point at 200 Torr.

Figure 3:
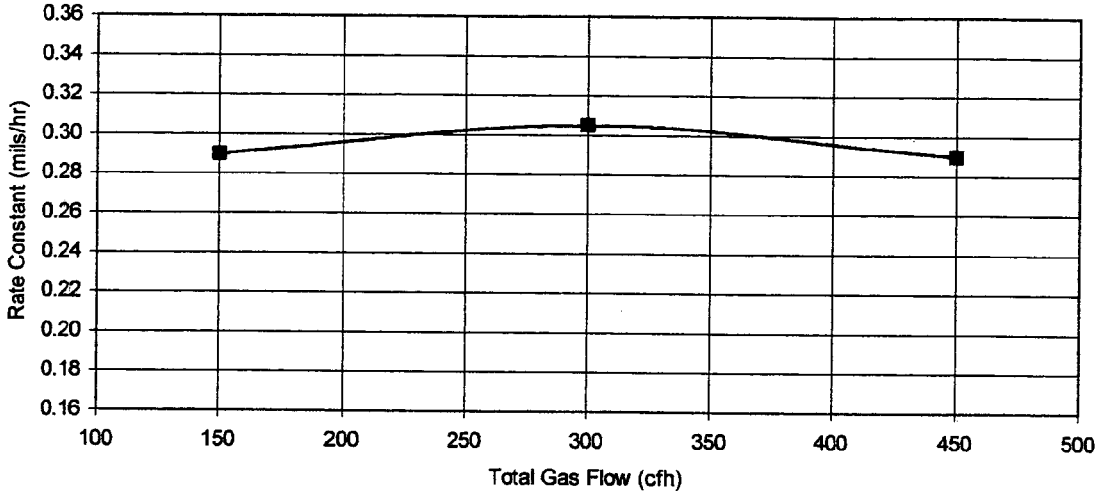
FIG. 3 is a graph of diffusion growth rate constants obtained from 10 hour CVD aluminizing cycles with various gas flow rates for Rene' N5 superalloy. Process variables held constant were the temperature (1080° C.), $AlCl_3$ concentration (1.0%) and retort pressure (200 Torr).

FIG. 3 summarizes the data from the third series of test runs. In particular, FIG. 3 shows a plot of the apparent growth rate constant as a function of total gas flow rate in the coating retort at 200 Torr total pressure and a gas concentration of 1.0% by volume $AlCl_3$ in the reactor for coating on the Rene' N5 superalloy. There appears to be an apparent maximum inflection point in the rate of coating growth at a flow rate of 300 scfh for this superalloy.

From these observations, it is apparent that there is an optimum set of conditions with which to produce diffusion aluminide coatings via CVD based on the fastest rate of growth for the coatings on the superalloy. Generally, in practicing the invention, a substrate coating temperature of about 900 to about 1200 degrees is employed. A coating gas flow rate is flowed through the retort coating chamber at a flow rate of about 100 to about 450 scfh. A concentration of $AlCl_3$ in the coating gas in the coating chamber is less than 1.4% by volume of the coating gas, the balance being substantially hydrogen. An inert gas such as argon may be present along with hydrogen. The total pressure of coating gas in the coating chamber is about 100 to about 450 Torr.

Preferred coating parameters comprise a substrate temperature of about 1080 degrees C., a flow rate of coating gas through a coating chamber of 200 to 400 scfh, a concentration of $AlCl_3$ in the coating chamber of about 0.6 to about 1.2% by volume of the coating gas, and a total pressure of the coating gas in the coating chamber of about 100 to about 300 Torr.

For the conditions examined in the above tests runs, the optimum coating conditions for Rene' N5 and other superalloys appear to be as follows:

TABLE I

Observed Conditions for CVD Aluminizing of Rene' N5 Alloy

| Variable | Optimum |
|---|---|
| Reactor Pressure | 200 Torr |
| $AlCl_3$ Concentration | 1.0% by vol. |
| Total Gas Flow Rate | 300 scfh |

The Optimum retort pressure of 200 Torr is selected over the 450 Torr retort pressure since in general lower retort pressure produces better coating uniformity.

Electron Microprobe Chemical Analysis

Figure 4:
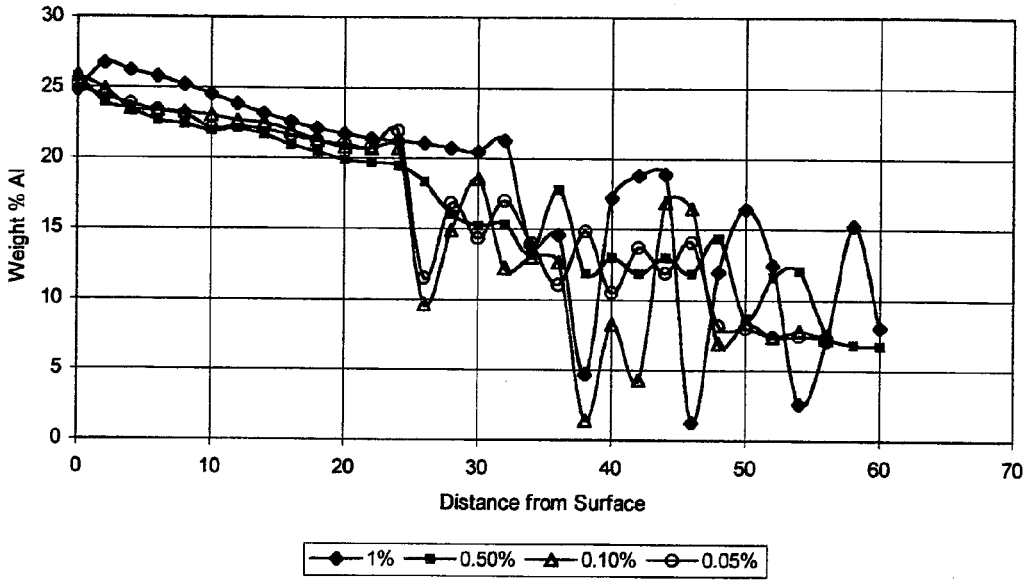
FIG. 4 is a graph of aluminum concentration profiles (in weight %) across the aluminide coatings formed on Rene' N5 superalloy starting from the coating outer surface S, which corresponds to 0 distance on the horizontal axis. Shown are electron probe microanalysis (EPMA) profiles from samples obtained from rapid cycle variants of CVD simple aluminizing runs, for various concentrations of $AlCl_3$. The remaining run parameters were a pressure of 450 Torr and a total gas flow of 300 scfh.
Figure 5:
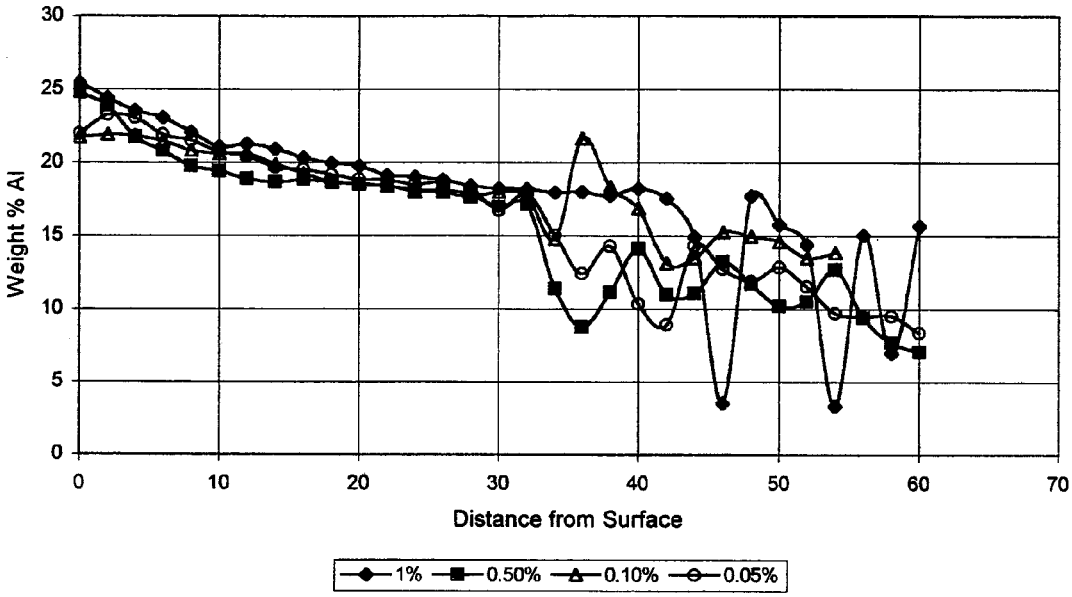

FIG. 4 (simple aluminide coating) and FIG. 5 (Pt modified aluminide coating) show the variation of aluminum concentration through the additive layer P of the coatings on Rene' N5 produced with different concentrations of $AlCl_3$ in the coating retort. In each of these figures, the profiles obtained from coatings produced at four $AlCl_3$ concentrations (a 1%, b=0.5, c=0.1% and d=0.05% by volume) with constant temperature (1080° C.), total pressure (200 Torr) and gas flow rate (300 scfh) are provided. The distributions of aluminum through the coatings obtained at 1% $AlCl_3$ are consistently more favorable than those obtained from the test runs. It is interesting to note that the aluminum concentrations obtained from any of the 1% $AlCl_3$ processes are generally higher at any given depth from the outer surface S (0 distance on the X axis) of the additive layer than virtually all others obtained from the test runs. The aluminum concentration in the aluminide diffusion coatings formed at 1% $AlCl_3$ has a maximum of 23-26 wt. % near the outer surface S with the aluminum concentration decreasing at a slower rate toward the diffusion zone Z than all other coatings of the examples.

Figure 6:
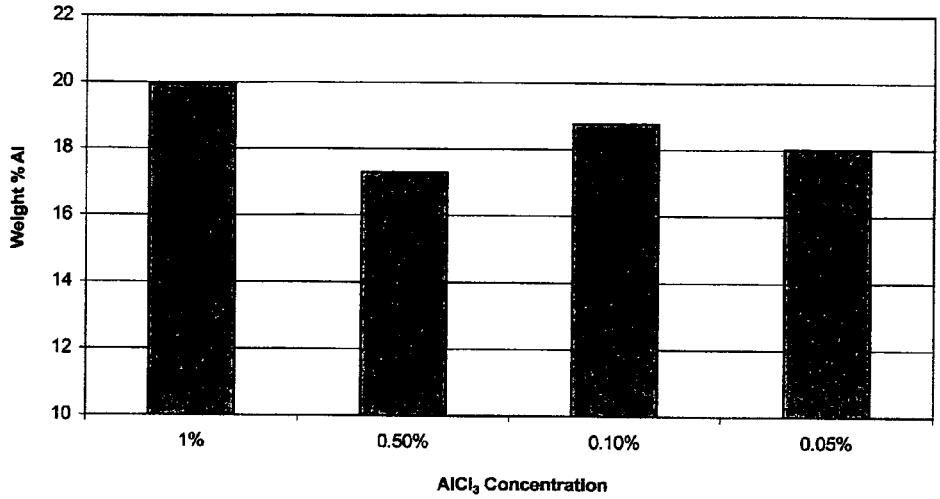
FIG. 6 is a bar graph of the average aluminum concentration (in weight %) measured in the additive layers of aluminide coatings obtained using $AlCl_3$ concentration variants of the rapid cycle CVD aluminizing process formed on Rene' N5 superalloy. For these samples, the retort pressure was 450 Torr and the total gas flow rate was 300 scfh for the different $AlCl_3$ concentrations.

FIG. 6 illustrates and compares the average aluminum concentration in the additive layer of the aluminide diffusion coatings for a representative number of conditions outlined in this series of test runs. The average aluminum concentration in the additive layer of the aluminide diffusion coatings (based upon an average of all profile points in the additive layer) increases as the concentration of $AlCl_3$ in the coating chamber increases from 0.05 to 1.0% by volume. It should also be noted that the test runs described in the examples were run at a total coating cycle time of 10 hours, rather than the customary 16 hours of often used for low activity CVD aluminizing at different coating parameters.

Figure 7:
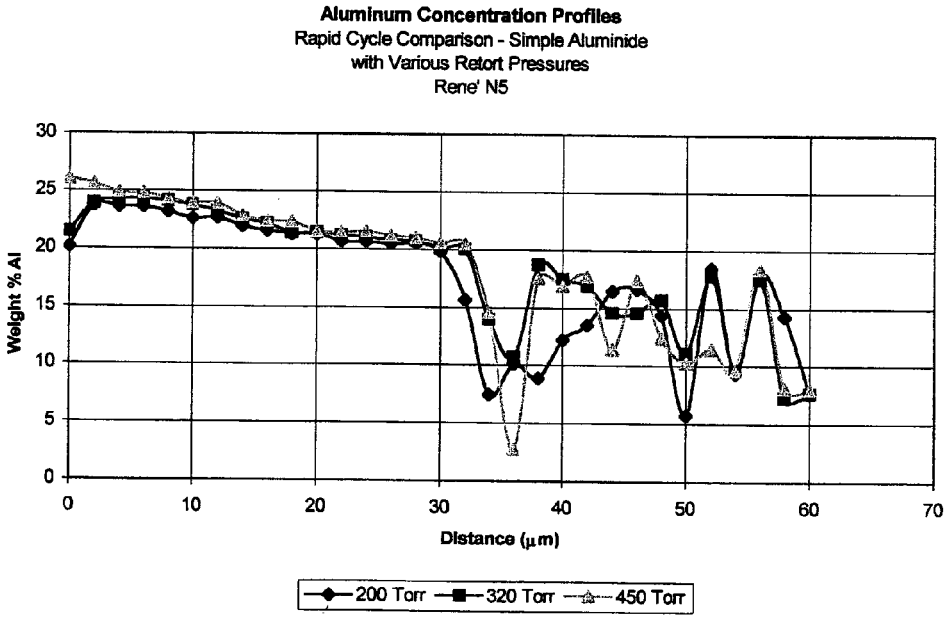
Figure 8:
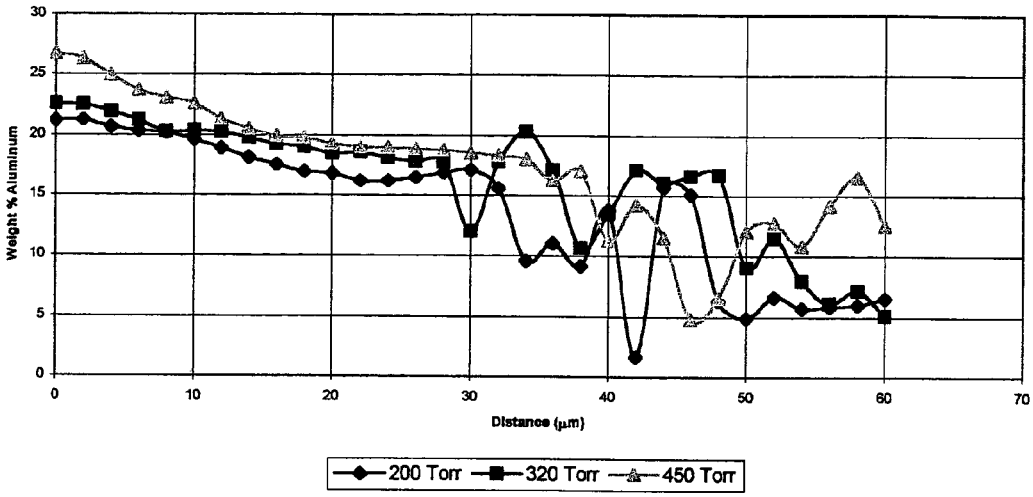
Figure 9:
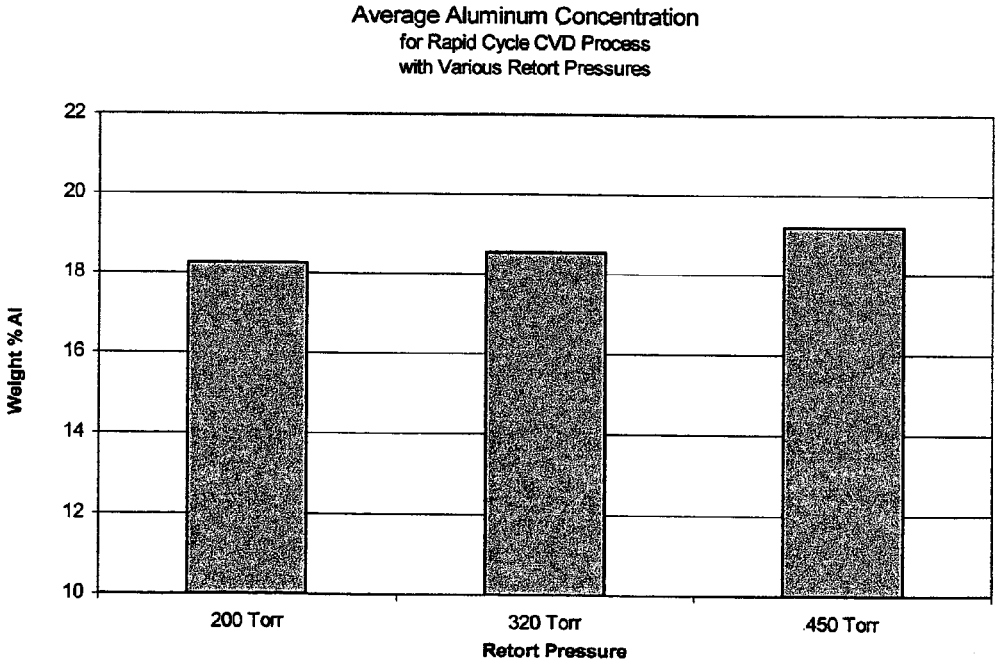
FIG. 9 is a bar graph of the average aluminum concentration (in weight %) measured in additive layers of aluminide coatings obtained using retort pressure variants of the rapid cycle CVD aluminizing process for alloy Rene' N5 superalloy. For these samples, the $AlCl_3$ concentration was 0.10% and the total gas flow rate was 300 scfh for retort pressures used.

The composition profiles obtained from samples processed at various retort pressures (200, 320 & 450 Torr) with constant temperature (1080° C.), gas flow rate (300 scfh) and $AlCl_3$ concentration (0.10% by volume of coating gas in the retort) are shown in FIG. 7 for simple aluminide coated Rene' N5, and FIG. 8 for platinum aluminide coated Rene' N5. As can be seen in these figures, the concentration of aluminum is slightly higher across the additive layer at any given depth from the outer surface S (0 distance on X axis) as the total retort pressure increases. That is, the average aluminum concentration in the additive layer increases as the retort pressure increases at this particular concentration of $AlCl_3$ gas. FIG. 9 illustrates this point for platinum aluminide coated substrates.

Cyclic Oxidation Testing

Cyclic oxidation testing was done on the coated samples and the average number of cycles to failure (at −2 $mg/cm^2$ mass change) was calculated for each coating type tested. Then, for each coating type, the average cycles to failure was divided by the initial coating thickness, yielding the cycles to failure per unit thickness. Normalizing for thickness allows direct comparison of the oxidation resistance of the various coatings considered.

Figure 10:
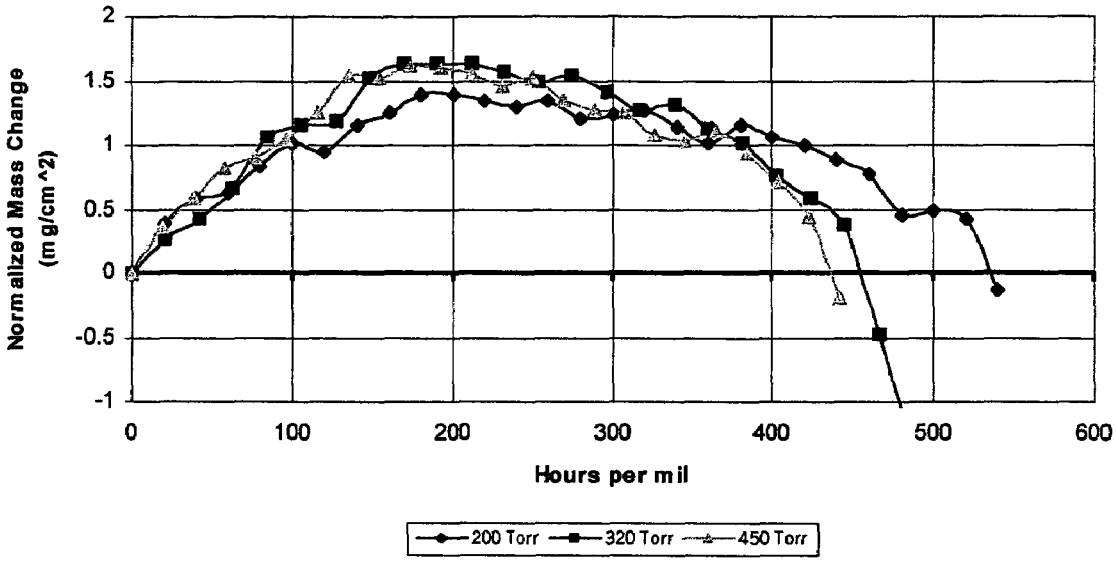
FIG. 10 is a graph of the cyclic oxidation behavior of tab samples of Rene' N5 superalloy having a platinum aluminide coating and tested at 1177° C. (2150° F.). Samples obtained from three retort pressure variants of the rapid cycle CVD process are displayed. The plots represent three (3) samples for each condition.

FIG. 10 provides normalized oxidation data for Rene' N5 superalloy coated with a platinum aluminide diffusion coating plotted as a function of total retort pressure for samples processed at constant: substrate temperature (1080° C.), gas flow rate (300 scfh), and $AlCl_3$ concentration (0.10% by volume of coating gas in the coating chamber) and the resulting graph is shown in FIG. 10. The data indicates oxidation resistance of the platinum modified aluminide diffusion coatings tested increases as pressure in the coating retort decreases with retort pressure of 200 Torr producing the best oxidation resistance, the retort pressure of 320 Torr the next best, and so on.

The above results indicate reductions in both the $AlCl_3$ concentration and the total pressure in the retort coating chamber result in both increased coating rate and increased oxidation resistance of the coating. The observed variation of the growth rate and the oxidation resistance with total pressure and aluminum trichloride concentration in the coating retort was both significant and unexpected.

Although the invention has been described with respect to certain embodiments thereof, those skilled in the art will appreciate that various modifications, changes and the like can be made in the invention within the scope of the appended claims.

We claim:

1. A method of forming an outwardly grown aluminide diffusion coating on a superalloy substrate disposed in a coating chamber, comprising heating the substrate to a temperature of 900 to 1200 degrees C., flowing a coating gas mixture comprising aluminum trichloride and a carrier gas through the chamber at a flow rate of the coating gas of about 100 to about 450 standard cubic feet per hour, providing a concentration of aluminum trichloride of less than about 1.4% by volume of the coating gas mixture in the chamber, and providing a total pressure of the coating gas mixture in the chamber of about 100 to about 450 Torr to increase coating rate of the outwardly grown aluminide diffusion coating on the substrate.

2. The method of claim 1 wherein the flow rate of coating gas mixture through the chamber is 200 to 400 standard cubic feet per hour, the concentration of aluminum trichloride is about 0.6 to about 1.2% by volume of the coating gas mixture in the chamber, and the total pressure of the coating gas mixture in the chamber of about 100 to about 300 Torr.

3. The method of claim 2 wherein the flow rate of coating gas mixture through the chamber is 300 standard cubic feet per hour, the concentration of aluminum trichloride is about 1.0% by volume of the coating gas mixture in the chamber, and the total pressure of the coating gas mixture in the chamber is about 200 Torr.

4. The method of clam 1 including before forming the coating on the substrate, depositing a layer comprising platinum on the substrate.

5. The method of claim 1 wherein the coating gas mixture comprises aluminum trichloride and balance hydrogen.

6. The method of claim 1 wherein the substrate is heated to a temperature of about 1080 degrees C.

* * * * *